US006216298B1

(12) United States Patent
Oliveira

(10) Patent No.: US 6,216,298 B1
(45) Date of Patent: Apr. 17, 2001

(54) TRAVEL PILLOW

(76) Inventor: Maria Connie Oliveira, 108 Grape St., New Bedford, MA (US) 02740

( * ) Notice: Subject to any disclaimer, the term of this patent is extended or adjusted under 35 U.S.C. 154(b) by 0 days.

(21) Appl. No.: 09/317,910

(22) Filed: May 24, 1999

(51) Int. Cl.[7] ..... A47C 1/10; A47G 9/00
(52) U.S. Cl. ..... 5/636; 5/640; 297/393
(58) Field of Search ..... 5/636, 637, 640; 297/391, 393, 397

(56) References Cited

U.S. PATENT DOCUMENTS

| | | | | |
|---|---|---|---|---|
| 98,859 | * | 1/1870 | Fast | 297/393 |
| 556,088 | | 3/1896 | Daly | 441/123 |
| 673,872 | * | 5/1901 | von Hillern-Flinsch | 297/393 |
| 941,043 | | 11/1909 | Powell | 5/644 X |
| 1,510,187 | | 9/1924 | Martin | 297/323 |
| 2,336,707 | | 12/1943 | Thompson | 5/636 |
| 3,164,151 | | 1/1965 | Nicoll | 128/DIG. 23 |
| 4,617,691 | | 10/1986 | Monti et al. | 5/636 X |
| 4,679,263 | | 7/1987 | Honer | 5/640 |
| 4,738,488 | | 4/1988 | Camelio | 5/636 X |
| 4,776,049 | | 10/1988 | Perron | 5/636 X |
| 4,838,611 | * | 6/1989 | Talaugon | 297/397 X |
| 5,220,700 | | 6/1993 | Lui | 5/636 |
| 5,519,906 | | 5/1996 | Fanto-Chan | 5/636 X |
| 6,052,848 | * | 4/2000 | Kelly | 5/640 X |

FOREIGN PATENT DOCUMENTS

| | | | |
|---|---|---|---|
| 1076118 | 10/1954 | (FR) | 5/636 |

* cited by examiner

*Primary Examiner*—Terry Lee Melius
*Assistant Examiner*—Robert G. Santos

(57) ABSTRACT

A travel pillow having an arch-shaped padded cushion surrounding an inner perimeter containing less padding so that the head of a child may be placed within the larger arch for support, with said cushion contained within a cover having two straps extending downward below the waist of the user to form two end points which attach to each other with one placed under and one over the child's seat belt.

1 Claim, 4 Drawing Sheets

TRAVEL PILLOW

BACKGROUND

1. Field of Invention

The present invention relates generally to a pillow used to support the head of a child while riding in a motor vehicle, with said child of sufficient age to not require a car seat.

2. Description of Prior Art

The prior art demonstrates many attempts to provide for the comfort of older children who ride without a car seat in a motor vehicle with their seat belts fastened. One attempt is the use of a common pillow which is unattached to the vehicle and can be used by children as a head rest while reclining in their seat. While this method provides some comfort and is inexpensive, the use of an unattached pillow does not provide the child with any additional safety in the event of an automobile accident as the pillow will itself be tossed about the passenger cabin in that event. A second attempt to resolve this problem is through the use of various cushioning attachments to seat belts providing a better fitting restraint mechanism for the child's safety. U.S. Pat. No. 4,619,468 to Spill demonstrates such a padded cover for a shoulder and lap seat belt as does U.S. Pat. No. 4,786,080 to Jay. U.S. Pat. No. 5,016,915 to Perry provides a padding and restraint system for a lap belt. Though all provide comfort to the wearer and appear relatively inexpensive, in the event of an automobile accident the head and neck of the child remain unprotected as there is no direct restraint or padding in the head or neck area. A third attempt are through the use of devices which are directly attached to the head of neck of the child. U.S. Pat. No. 4,738,488 to Camelio and U.S. Pat. No. 4,617,691 to Monti, et al illustrate such devices which are directly attached to the child. While these provide excellent head and neck support they are extremely uncomfortable to any adult let alone to a child whose tolerance is well below the adult standard.

Therefore, there exists a need for a travel pillow which can be used by children who no longer use car seats, while providing said children with a means to hold and cushion their heads and necks such that they are supported in the event the child falls asleep or is involved in a traffic accident and yet be tolerable and comfortable by a child so that he or she will accept its use.

SUMMARY OF THE INVENTION

Accordingly, a travel pillow having a arch-shaped padded cushion surrounding an inner perimeter containing less padding so that the head of a child may be placed within the larger arch for support, with said cushion contained within a cover having two straps extending downward below the waist of the user to form two end points which attach to each other with one placed under and one over the child's seat belt.

The invention provides support to the head and neck of an older child who no longer uses a car seat.

DESCRIPTION OF THE PREFERRED EMBODIMENT

Referring to FIGS. 1 through 4, the arch-shaped padded cushion of the invention is generally indicated at 10, and the semi-circular area which is surrounded by the arch-shaped padded cushion is generally indicated at 11. The invention is preferably manufactured of a cotton cloth fiber and is shaped in a likeness to the head of an animal or other design 12 which is then screen printed onto the invention as shown in 13. The padding used within the invention is polyester or any other commonly available stuffing material. However, other shapes and other construction materials are contemplated.

Figure 1:
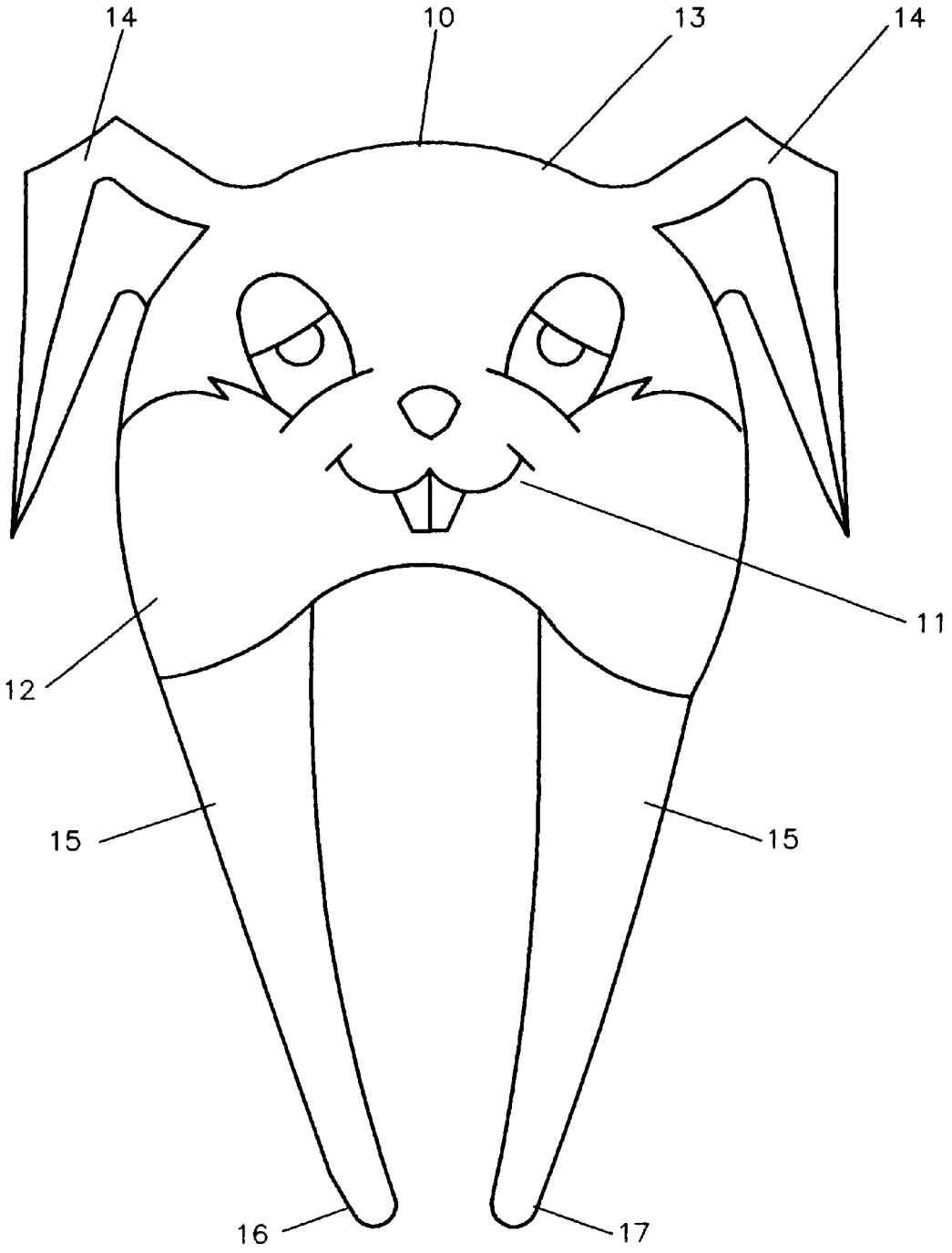
FIGS. 1 and 2 are depictions of the invention viewed from the front with different character definitions
Figure 2:
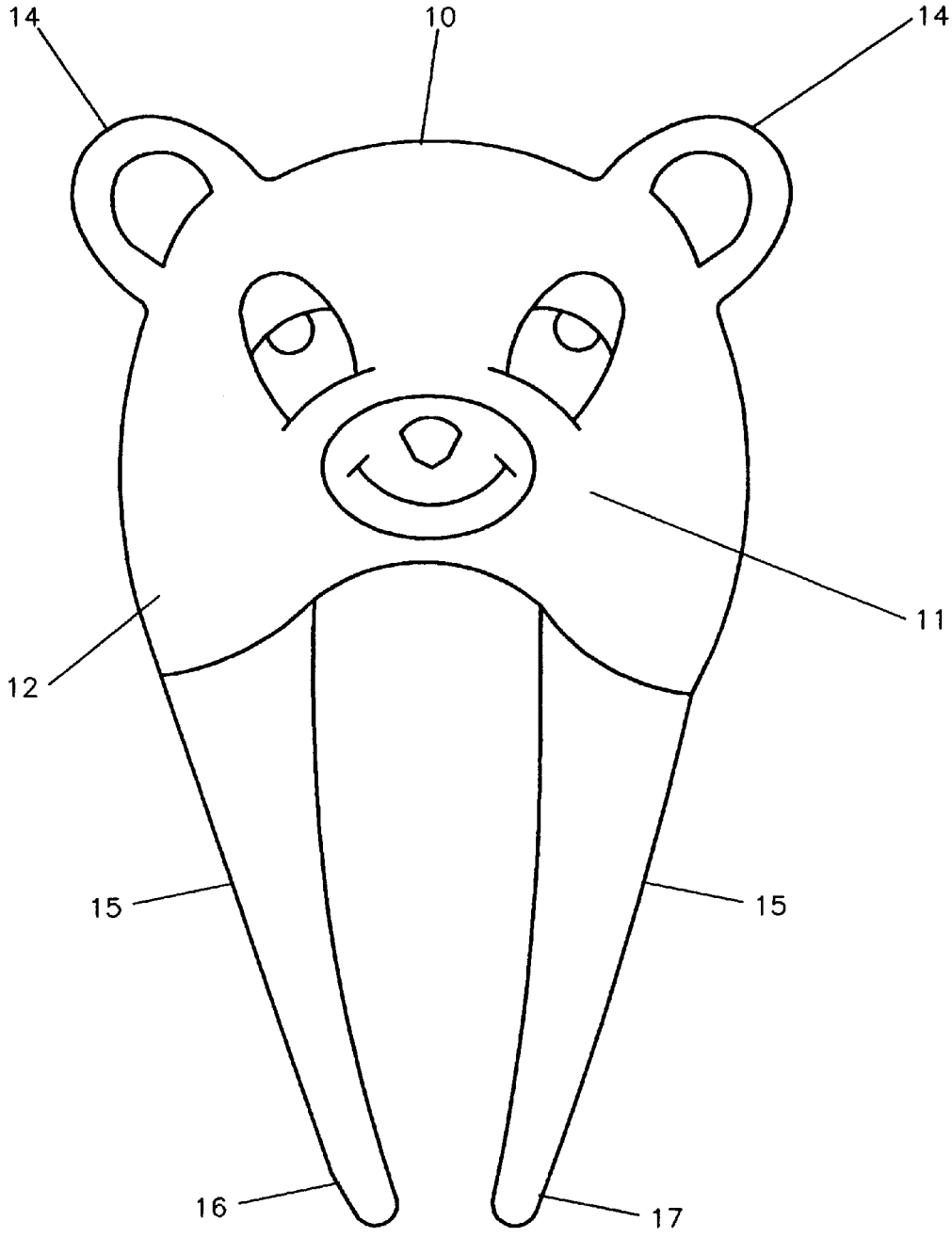

Referring now to FIGS. 1 and 2, extensions may be added to the arch-shaped padded cushion as indicated 14 to represent an extension of the character depicted thereon. The two unpadded cloth extensions are attached 15 to the base points of the arch-shaped padded cushion. At the outermost portion of each of the unpadded cloth extensions 16, 17 there is installed a method of attachment to attach one to the other. Said installation may include commercially available pieces of a self-adhesive surface which attach to one another or a button and buttonhole.

Figure 3:
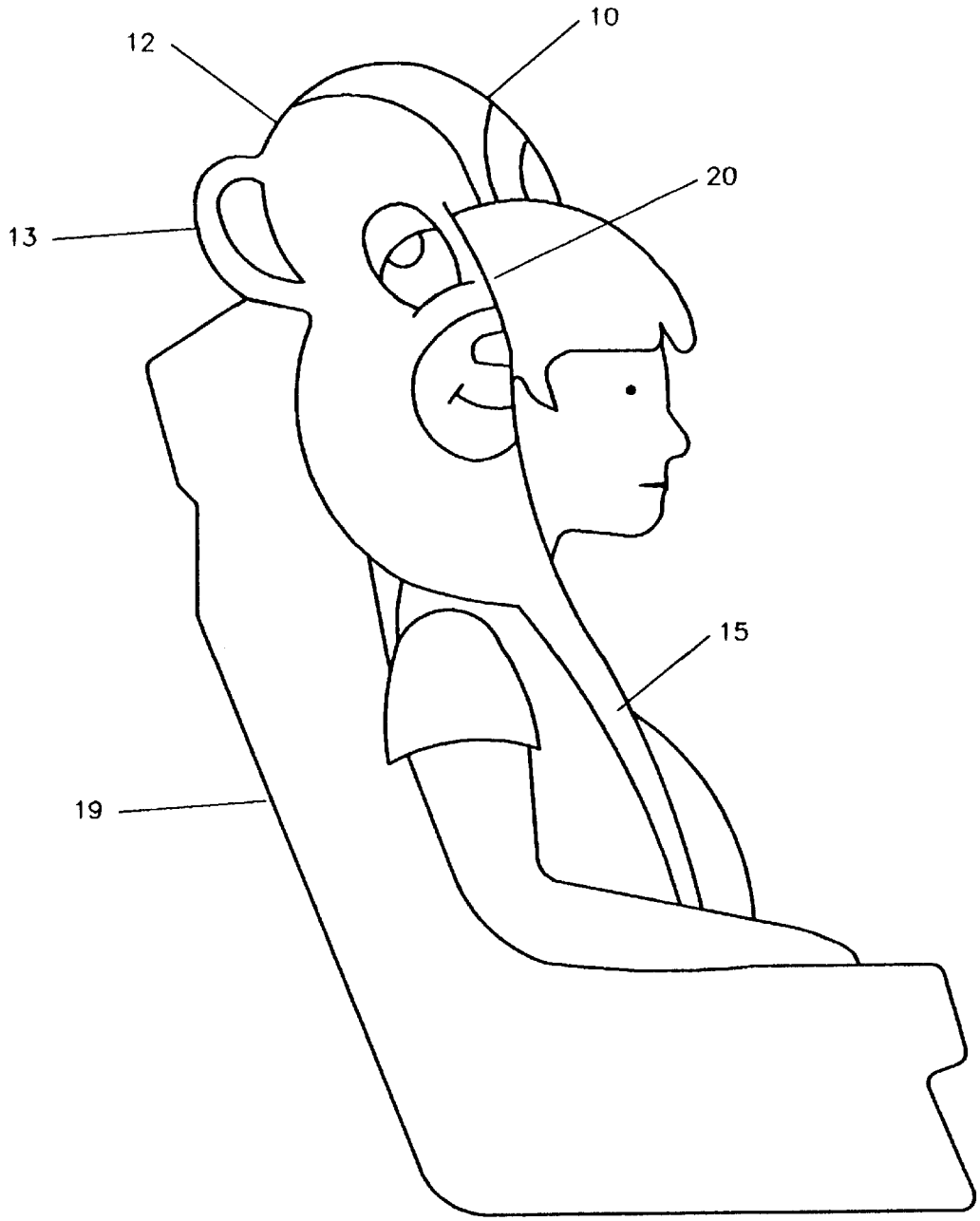
FIG. 3 depicts the invention as used by a child and as attached to a seat belt.
Figure 4:
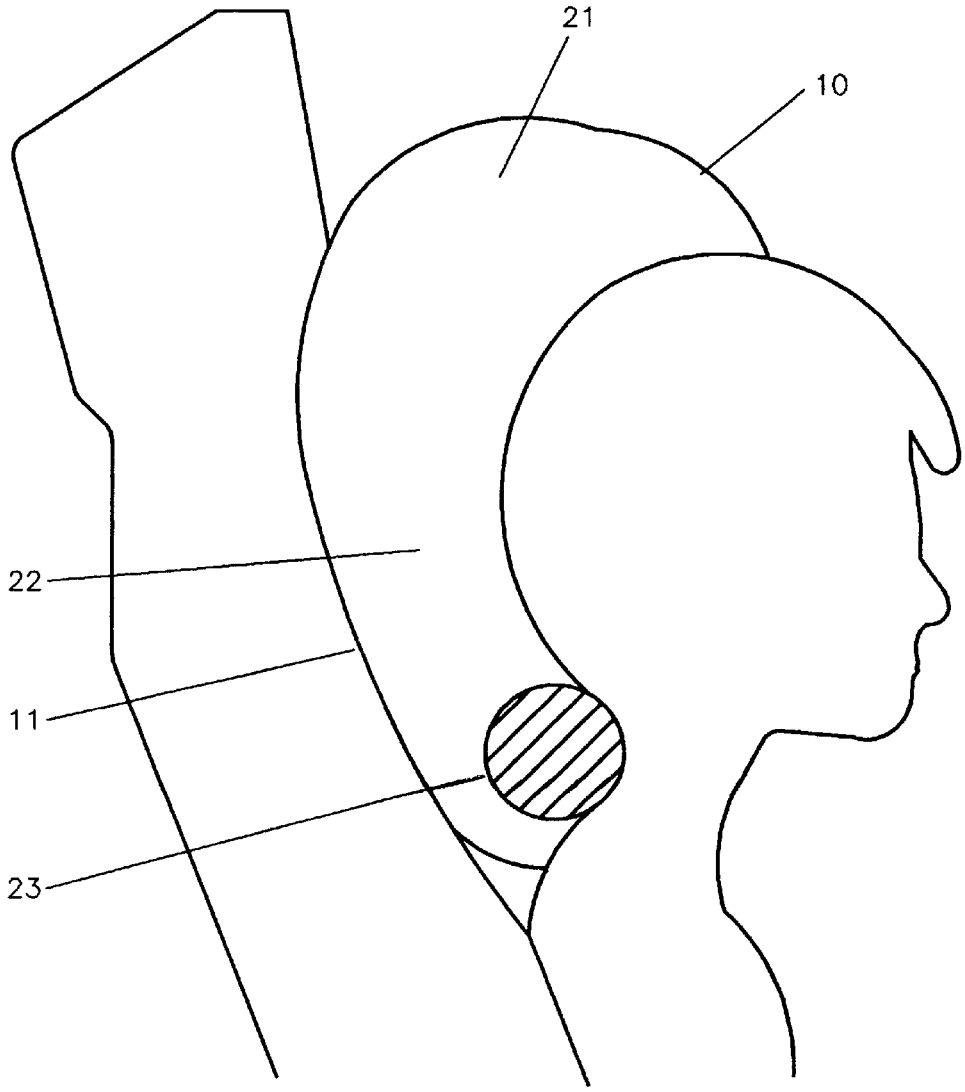
FIG. 4 is a cross-section of the invention while in use, viewed from the side.

Referring now to FIGS. 3 and 4, the method of use of the invention is depicted. A child 18 is seated in a car seat 19 and has placed around his waist and shoulders a seat belt. The head of the child 20 is placed against the semi-circular portion of the invention 11. One of the unpadded cloth extensions is placed under the seat belt while the other is placed over the top of the seat belt. The two unpadded cloth extensions 15 are attached to each other. In this manner the invention is secured and the child's head and neck are supported.

Referring now to FIG. 4, the depth of the arch-shaped padded cushion is indicated at 21 as well as the depth of the surrounded semi-circular area 22. A support for the neck may be added 23. Other proportions and sizes are contemplated to fit differently sized children.

While a particular embodiment of the invention is shown, it will be understood by those skilled in the art that changes and modifications may be made thereto without departing from the invention in its broader aspects and as set forth in the following claims.

What is claimed is:

1. A head support in combination with a motor vehicle seat for providing bilateral side support to the head of a child, wherein the head support is placed against said motor vehicle seat with the body of the child oriented in a substantially vertical upright position, said support consisting of a padded cushion in the shape of an arch wherein the inner perimeter of the arch contains less padding than the outer perimeter, said arch is placed against said motor vehicle seat such that the periphery of the user's head is substantially placed within said arch, wherein said arch is encased within a covering which forms two straps which extend downwardly a substantial distance from said cushion to form two end points having a means of attachment to one another and attach during use in a manner wherein one strap is placed under and one strap is placed over a motor vehicle seat belt of said motor vehicle seat.

* * * * *